US011910923B2

(12) United States Patent
French

(10) Patent No.: US 11,910,923 B2
(45) Date of Patent: Feb. 27, 2024

(54) SHELVING UNIT

(71) Applicant: Daniel L French, Greeley, CO (US)

(72) Inventor: Daniel L French, Greeley, CO (US)

( * ) Notice: Subject to any disclaimer, the term of this patent is extended or adjusted under 35 U.S.C. 154(b) by 0 days.

(21) Appl. No.: 17/685,026

(22) Filed: Mar. 2, 2022

(65) Prior Publication Data

US 2023/0276942 A1 Sep. 7, 2023

(51) Int. Cl.

| | |
|---|---|
| ***A47B 77/10*** | (2006.01) |
| ***A47B 51/00*** | (2006.01) |
| ***A47B 77/16*** | (2006.01) |
| ***A47B 96/02*** | (2006.01) |

(52) U.S. Cl.

CPC ..... *A47B 77/10* (2013.01); *A47B 51/00* (2013.01); *A47B 77/16* (2013.01); *A47B 96/025* (2013.01)

(58) Field of Classification Search

CPC ..... A47B 77/10; A47B 77/16; A47B 51/00; A47B 96/025; A47B 2005/003; A47B 2051/005; A47B 43/003; A47B 43/006; A47B 49/008; A47B 77/18

USPC .... 211/150, 1.51, 126.15; 108/106, 42, 182; 248/243, 286.1

See application file for complete search history.

(56) References Cited

U.S. PATENT DOCUMENTS 176,512 A * 4/1876 Chinnery ..... A47B 43/006 108/147.11
957,324 A * 5/1910 Gall ..... E04G 5/043 248/245
1,145,264 A * 7/1915 Pflug ..... A47B 46/005 312/246
2,537,669 A * 1/1951 Honig ..... A47B 67/02 312/269
2,599,416 A * 6/1952 Carleton ..... A47B 23/04 248/447
2,640,599 A * 6/1953 Hess ..... A47B 96/025 108/29
2,744,805 A * 5/1956 McMahan ..... A47B 21/02 312/27
3,485,544 A 12/1969 Beckerman
3,623,168 A * 11/1971 Rouch ..... A47C 17/40 5/10.1
3,857,623 A * 12/1974 Schneller ..... A47B 46/005 312/294
4,184,725 A 1/1980 Spangler
4,343,244 A * 8/1982 Moriarty ..... A47F 7/144 108/1
4,485,928 A * 12/1984 Staashelm ..... A47B 46/00 312/246
4,568,132 A * 2/1986 Watt ..... A47B 51/00 312/271
4,846,304 A 7/1989 Rasmussen
4,915,461 A * 4/1990 Kingsborough ..... A47B 77/10 312/247

(Continued)

FOREIGN PATENT DOCUMENTS

KR 202020001330 U 6/2020

*Primary Examiner* — Jennifer E. Novosad
(74) *Attorney, Agent, or Firm* — Barnes & Thornburg LLP; Jerry C. Harris, Jr.

(57) ABSTRACT

A shelving unit includes a shelf configured to move between a retracted position and an extended position. At least one arm extends from the shelf and is moveably coupled to a track or dual hinges and configured to move along the track to move the shelf between the retracted position and the extended position.

11 Claims, 14 Drawing Sheets

(56) References Cited

U.S. PATENT DOCUMENTS 4,974,523 A * 12/1990 Giarratana ..... A47F 3/0486 108/42
5,108,063 A * 4/1992 Koerber, Sr. ..... F16M 11/24 248/920
5,228,763 A * 7/1993 Gingold ..... A47B 51/00 312/282
5,329,865 A * 7/1994 McWard ..... E05G 1/04 109/50
5,499,584 A * 3/1996 Taylor ..... A47B 46/005 312/266
5,556,179 A 9/1996 Weidner
5,560,501 A * 10/1996 Rupert ..... A47B 46/00 211/104
5,646,819 A * 7/1997 Hill, III ..... A47B 21/0314 361/679.6
5,725,293 A * 3/1998 Wilkening ..... E04H 6/42 211/116
5,785,183 A * 7/1998 Rejete ..... A47F 5/10 211/1.51
5,957,558 A * 9/1999 Quade ..... A47B 88/48 312/246
6,119,879 A * 9/2000 Acchione ..... A47B 77/10 211/171
6,318,567 B1 * 11/2001 Braley ..... A47B 49/004 248/37.3
6,367,898 B1 * 4/2002 Jobe ..... A47B 51/00 312/246
6,416,027 B1 * 7/2002 Hart ..... A47B 81/065 312/7.2
6,655,646 B2 * 12/2003 Johnson ..... A47B 46/005 248/286.1
6,997,531 B2 * 2/2006 Kim ..... A47B 46/005 108/93
7,100,882 B2 9/2006 Behroozi
7,316,326 B2 * 1/2008 Kim ..... F25D 25/027 211/90.03
7,618,103 B2 * 11/2009 Kim ..... F25D 25/024 108/138
7,950,756 B2 * 5/2011 Collins ..... F25D 25/02 312/248
8,424,693 B1 * 4/2013 Hoover ..... A47F 5/0062 211/126.15
8,424,983 B1 * 4/2013 Strauss ..... A47B 51/00 312/247
8,851,306 B2 * 10/2014 Spurr ..... A47B 46/005 211/117
9,016,811 B2 * 4/2015 Raunikar ..... A47B 88/473 312/249.7
9,055,813 B2 * 6/2015 Telthorster ..... A47B 51/00
9,145,093 B1 * 9/2015 Bard ..... B60R 5/04
9,486,073 B2 11/2016 Hopkins
9,572,427 B2 * 2/2017 Klooth ..... A47B 96/07
9,593,880 B2 * 3/2017 Choo ..... F25D 25/024
9,833,072 B1 * 12/2017 Knake ..... A47B 96/025
10,034,540 B1 * 7/2018 Abbott ..... A47B 77/10
10,408,531 B1 * 9/2019 Beck ..... F25D 25/024
10,420,418 B2 * 9/2019 Behroozi ..... F16M 13/022
10,561,235 B1 * 2/2020 Abbott ..... A47B 77/10
10,874,209 B1 * 12/2020 Dunseath ..... A47B 57/06
10,925,391 B1 * 2/2021 Stilley ..... B65D 21/086
11,191,353 B2 * 12/2021 Feeley ..... A47B 21/0314
11,266,235 B2 * 3/2022 Rinck ..... A47B 77/14
11,435,133 B1 * 9/2022 Barik ..... F25D 25/02
2002/0084395 A1 7/2002 Johnson
2004/0123781 A1 * 7/2004 D'Agostino ..... A47B 51/00 108/42
2006/0120846 A1 * 6/2006 Krengel ..... A47B 5/00 414/592
2006/0125362 A1 * 6/2006 Kim ..... F25D 25/024 312/408
2008/0203041 A1 * 8/2008 Lim ..... F25D 25/02 211/119.003
2008/0246382 A1 * 10/2008 Kang ..... A47B 57/06 312/408
2010/0163501 A1 * 7/2010 Berry ..... A47F 7/145 211/184
2012/0193313 A1 8/2012 Spurr et al.
2014/0203692 A1 * 7/2014 Marsters ..... A47B 46/005 312/246
2014/0252930 A1 * 9/2014 Reid ..... A47B 46/005 312/247
2015/0351570 A1 12/2015 Lukjan
2016/0238307 A1 * 8/2016 Lee ..... F25D 25/02
2017/0233987 A1 * 8/2017 Son ..... E03C 1/324 4/695
2022/0183460 A1 * 6/2022 Aghaei ..... A47B 51/00
2022/0225843 A1 * 7/2022 Eugene ..... A47K 5/04

* cited by examiner

SHELVING UNIT

TECHNICAL FIELD

The present invention is directed to a shelving unit and, more particularly, to a shelving unit for use under a fixture.

BACKGROUND

In many kitchens, counter space can be limited. The counter is typically used to store appliances such as toasters, coffee makers, blenders, air fryers, utensil holders, and the like. Additionally, with the increasing number of mobile devices in households, counters have become even more cluttered. Often, the kitchen counter is cluttered with multiple mobile devices and charging cords. Accordingly, it can be difficult to cook and clean dishes within many kitchens. A need remains for providing more storage in a kitchen. Moreover, a general need remains for providing storage under any cabinet.

SUMMARY

The present disclosure includes one or more of the features recited in the appended claims and/or the following features which, alone or in any combination, may comprise patentable subject matter.

According to a first aspect of the disclosed embodiments, a shelving unit includes a shelf configured to move between a retracted position and an extended position. The shelf has a back end configured to secure to a fixture in both the retracted position and the extended position. The shelf has a front end positioned opposite the back and cantilevered in both the retracted position and the extended position. At least one arm extends from the shelf. The at least one arm has a shelf end coupled to the back end of the shelf and an opposite track end. A track is secured to the fixture. The track end of the at least one arm is moveably coupled to the track and configured to move along the track to move the shelf between the retracted position and the extended position.

In some embodiments of the first aspect, the back end of the shelf can move in a plane between the retracted position and the extended position. The track end of the at least one arm can move along an axis along the track to move the shelf between the retracted position and the extended position. The axis can extend in a different direction than the plane. The axis can be orthogonal to the plane. The shelf end of the at least one arm can rotate relative to the back end of the shelf to move the shelf between the retracted position and the extended position. A motor can be configured to move the track end of the at least one arm along the track to move the shelf between the retracted position and the extended position. A plurality of inserts can be configured to be interchangeably positioned in the shelf. At least one of the plurality of inserts can be rotated to an angle relative to the shelf. The shelf can extend in a horizontal plane in both the retracted position and the extended position. The shelf can remain in the horizontal plane when moving between the retracted position and the extended position. The fixture can be a cabinet and the shelf can be sized to position under the cabinet in both the retracted position and the extended position. The cabinet can be positioned on a wall. The shelving unit can include at least one bumper positioned on the back end of the shelf to space the shelf from the wall.

Optionally, in the second aspect, the at least one arm can include a pair of arms. A first arm of the pair of arms can be coupled to a first side of the shelf and a second arm of the pair of arms can be coupled to a second side of the shelf. A length of both the first arm and the second arm can be no more than half a width of the track. A track end of the first arm and a track end of the second arm can move in opposite directions along the track when the shelf is moved between the retracted position and the extended position.

According to a second aspect of the disclosed embodiments, a shelving unit includes a shelf configured to move between a retracted position and an extended position. The shelf has a back end configured to secure to a fixture in both the retracted position and the extended position. The shelf has a front end positioned opposite the back end. The front end of the shelf is cantilevered in the extended position. At least one arm extends from the shelf. The at least one arm has a shelf end coupled to the back end of the shelf and configured to rotate relative to the shelf. A base is secured to the fixture. A base end of the at least one arm is coupled to the base and configured to rotate relative to the base to move the shelf between the retracted position and the extended position.

In some embodiments of the second aspect, the shelf can extend in a horizontal plane in both the retracted position and the extended position. The fixture can be a cabinet and the shelf can be sized to position under the cabinet in both the retracted position and the extended position. The at least one arm can include a pair of arms. A first arm of the pair of arms can be coupled to a first side of the shelf and a second arm of the pair of arms can be coupled to a second side of the shelf. A length of both the first arm and the second arm can be no more than a depth of a side of the shelf extending between the front end and the back end of the shelf.

According to a third aspect of the disclosed embodiments, a shelving unit includes a shelf configured to move between a retracted position and an extended position. The shelf has a back end configured to secure to a fixture in both the retracted position and the extended position. The shelf has a front end positioned opposite the back end. The front end of the shelf is cantilevered in the extended position. At least one arm extends from the shelf. The at least one arm has a shelf end coupled to the back end of the shelf and configured to move relative to the shelf. A base is secured to the fixture. A base end of the at least one arm is coupled to the base and configured to move relative to the base to move the shelf between the retracted position and the extended position.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
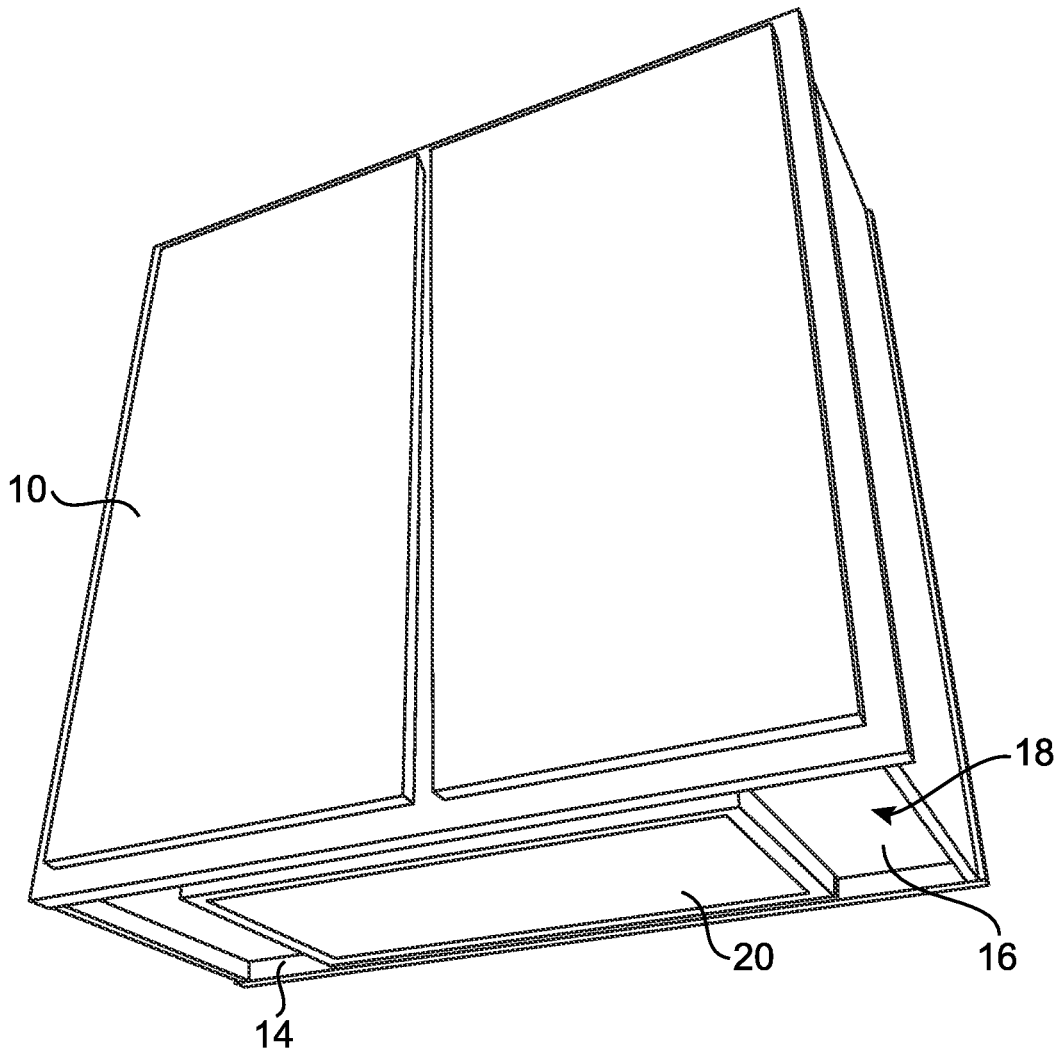
FIG. 1 is a perspective view of a shelving unit coupled under a cabinet and in a retracted position.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
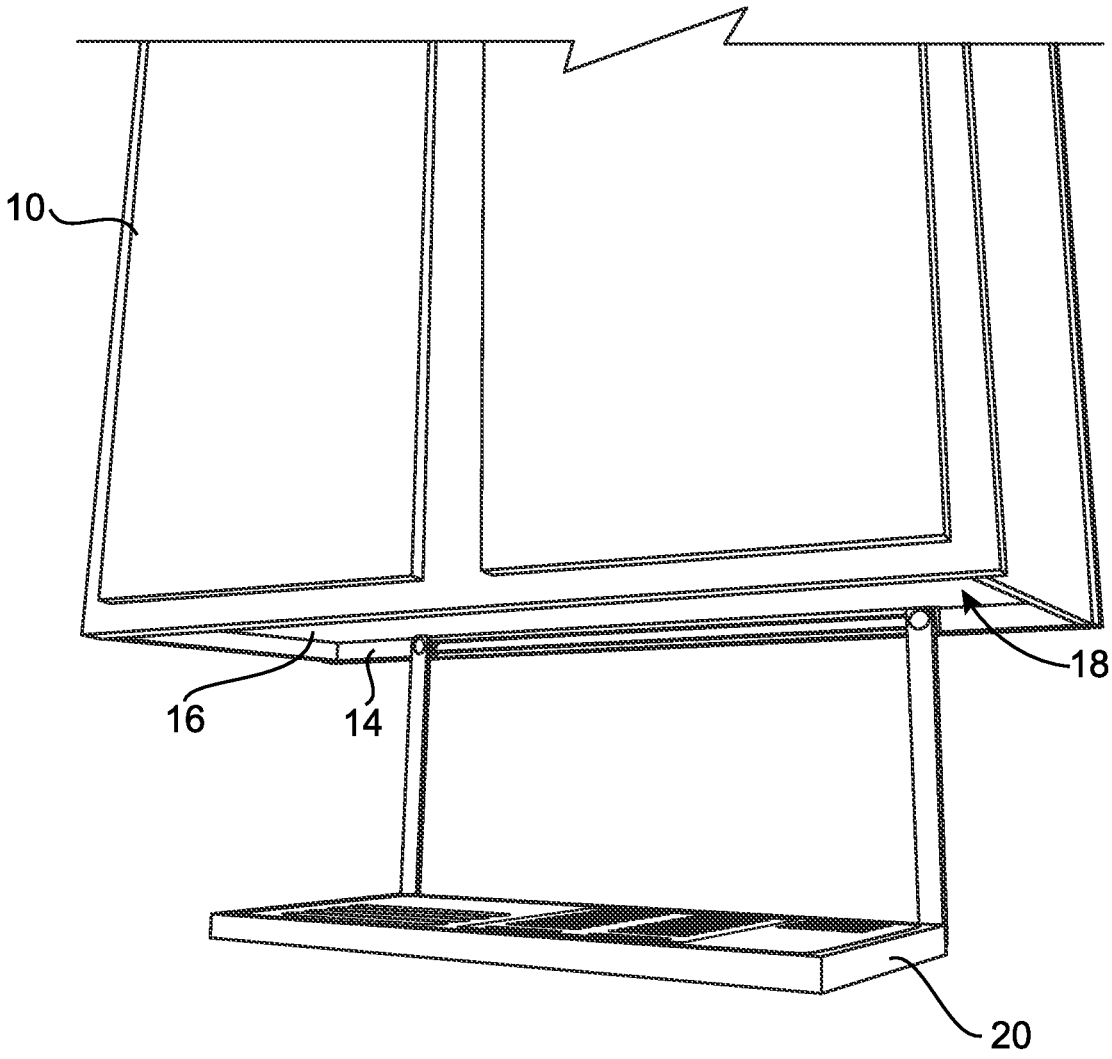
FIG. 2 is a perspective view of the shelving unit shown in FIG. 1 coupled under the cabinet and in an expanded position.

Referring now to FIGS. 1 and 2, a shelving unit 20 is configured to couple to a fixture 10. In the illustrated embodiment, the fixture 10 is a cabinet 12, and in particular, a kitchen cabinet. It will be appreciated that the fixture 10 can be any cabinet, for example, a garage cabinet or storage room cabinet; an underside of stairs; a shelf, for example, a closet shelf; or any suitable fixture. The shelving unit 20 is coupled to an underside of the fixture 10. That is, the shelving unit 20 is sized to be stored under the fixture 10 in a retracted position, as illustrated in FIG. 1.

The shelving unit 20 extends into an expanded position under the fixture 10, as illustrated in FIG. 2. In the expanded position, the shelving unit 20 is configured to provide additional storage. For example, the shelving unit 20 may include a cutting board, storage for mobile devices, space for cookbooks, a drying rack for dishes, space for cooking sheets, etc. Accordingly, in a kitchen setting, the shelving unit 20 provides space in addition to the counter space of the kitchen. The shelving unit 20 does not include any front obstructions, thereby allowing for larger pans or skillets to sit atop the shelving unit 20.

The shelving unit 20 is secured to the fixture 10, for example, with screws, bolts, or any other suitable fastening mechanism. The shelving unit 20 is sized and shaped to position under the fixture 10 in both the retracted position and the extended position. The fixture 10 includes a lower lip 14 that extends around a bottom 16 of the fixture 10. The bottom 16 and the lower lip 14 form a cavity 18 under the fixture 10. The shelving unit 20 is secured to the lower lip 14 and hangs freely from the lower lip 14. In other embodiments, as described below in FIGS. 8-10, the shelving unit 20 can be coupled to the bottom 16 and hang freely from the bottom 16. The shelving unit 20 retracts into the cavity 18 when the shelving unit 20 is moved into the retracted position, as illustrated in FIG. 1.

Figure 3:
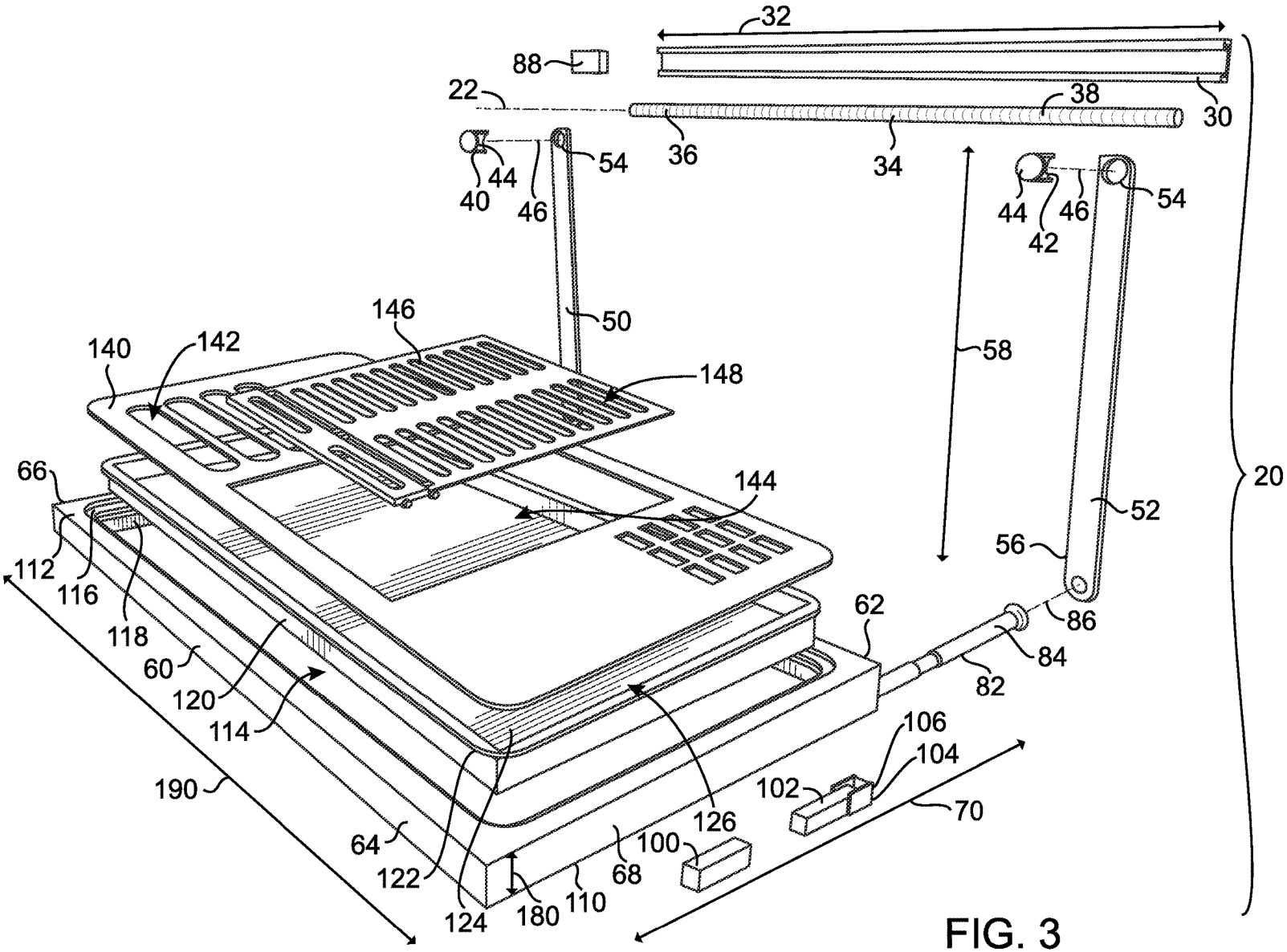
FIG. 3 is a right side exploded view of the shelving unit shown in FIG. 1.
Figure 4:
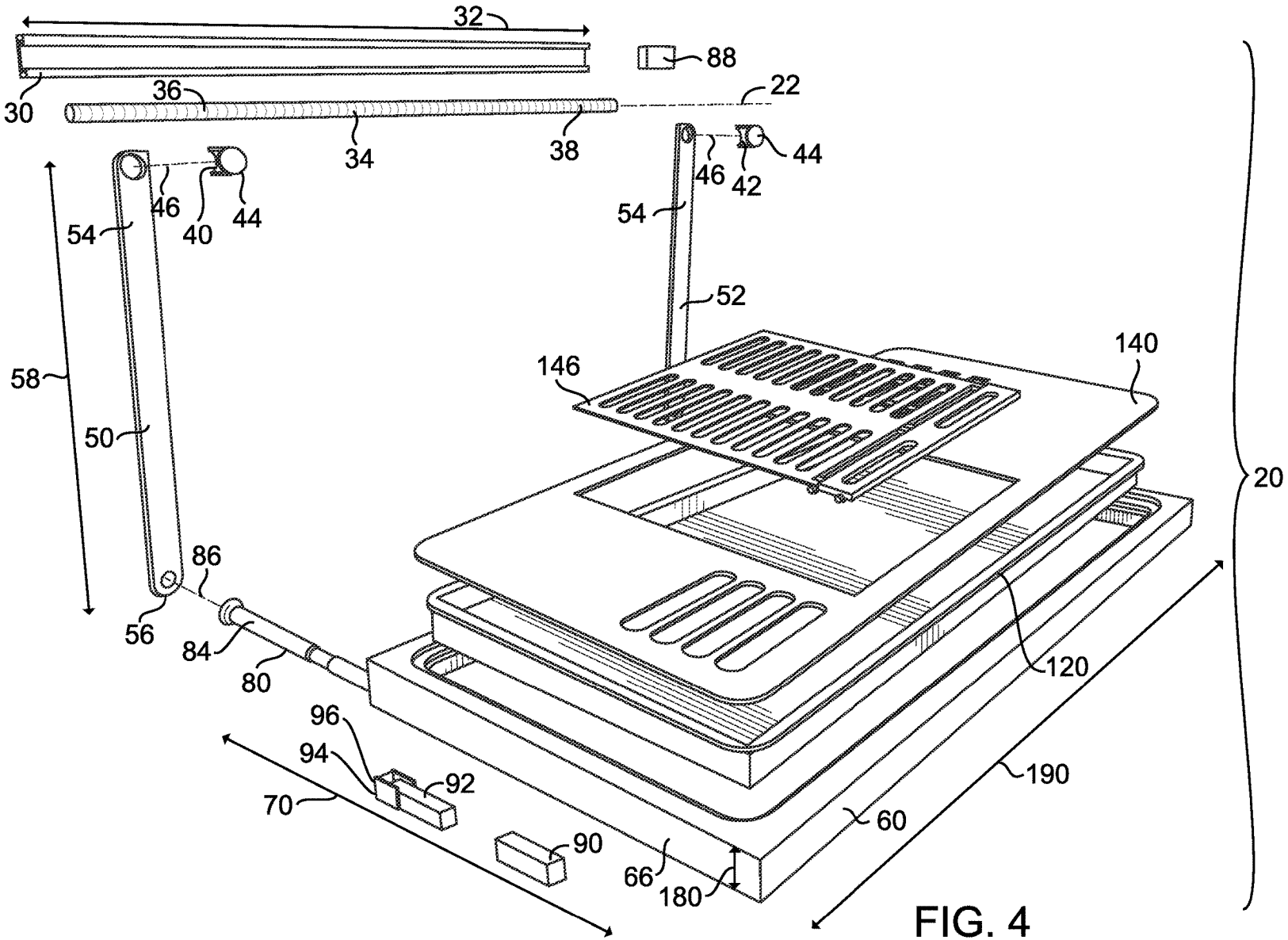
FIG. 4 is a left side exploded view of the shelving unit shown in FIG. 1.

Referring now to FIGS. 3 and 4, the shelving unit 20 includes a track 30 that couples to the fixture 10. For example, the track 30 couples to the lower lip 14 of the fixture 10. In some embodiments, the track 30 can be attached to inner-wall studs behind the fixture 10. The track 30 can be sized to extend an entire width of the lower lip 14 or sized to extend a portion of the width of the lower lip 14. In some embodiments, a width 32 of the track 30 is sized to a width of the fixture 10. A dual-threaded drive screw 34 is secured within and extends through the track 30 along a drive screw axis 22. The drive screw 34 includes a left side of threads 36 that helically circumvent the drive screw 34 in a first direction and a right side of threads 38 that helically circumvent the drive screw 34 in a second direction that is opposite the first direction. As used herein, the terms "left" and "right" are defined with respect to viewing the shelving unit 20 from a front side of the fixture 10.

A left slide 40 and a right slide 42 are coupled to the drive screw 34 and configured to travel along the drive screw 34 along the drive screw axis 22. Each of the left slide 40 and the right slide 42 includes a pivot 44 having a pivot axis 46. The left slide 40 is coupled to the left side of threads 36 and the right slide 42 is coupled to the right side of threads 38. Because the left side of threads 36 and the right side of threads 38 extend in opposite directions, rotation of the drive screw 34 moves the left slide 40 and the right slide 42 is opposite directions. For example, when the drive screw 34 is turned in a first rotational direction, the left slide 40 and the right slide 42 move apart. When the drive screw 34 is turned in a second rotational direction opposite the first rotational direction, the left slide 40 and the right slide 42 move together.

A left arm 50 and a right arm 52 are coupled to the track 30. Each of the left arm 50 and the right arm 52 includes a track end 54 and a shelf end 56. In some embodiments, a length 58 of each of the left arm 50 and the right arm 52 is no more than half the width 32 of the track 30. The left arm 50 is coupled to the pivot 44 of the left slide 40. That is, the track end 54 of the left arm 50 is coupled to the pivot 44 of the left slide 40. The left arm 50 is configured to move relative to the left slide 40 when the drive screw 34 is rotated. In the exemplary embodiment, the left arm 50 rotates relative to the left slide 40 about the pivot axis 46 of the pivot 44 of the left slide 40 when the drive screw 34 is rotated. The right arm 52 is coupled to the pivot 44 of the right slide 42. That is, the track end 54 of the right arm 52 is coupled to the pivot 44 of the right slide 42. The right arm 52 is configured to move relative to the right slide 42 when the drive screw 34 is rotated. In the exemplary embodiment, the right arm 52 rotates relative to the right slide 42 about the pivot axis 46 of the pivot 44 of the right slide 42 when the drive screw 34 is rotated.

A shelf 60 is coupled to both the left arm 50 and the right arm 52. The shelf end 56 of each of the left arm 50 and the right arm 52 are coupled to the shelf 60. The shelf 60 is sized and shaped to position in the cavity 18 of the fixture 10 when the shelving unit 20 is in the retracted position. The shelf 60 includes a back end 62 that is positioned adjacent a wall to which the fixture 10 is attached. The left arm 50 and the right arm 52 are coupled to the back end 62 of the shelf 60. The shelf 60 also includes a front end 64 positioned opposite the back end 62. The front end of the shelf 60 is configured to be cantilevered when the shelving unit 20 is in both the retracted and expanded position. A left side 66 and a right side 68 extend between the back end 62 and the front end 64. In some embodiments, the length 58 of each of the left arm 50 and the right arm 52 is no more than a depth 70 of the left side 66 and the right side 68 of the shelf 60.

A left post 80 extends from the left side 66 of the shelf 60 and a right post 82 extends from the right side 68 of the shelf 60. Each of the left post 80 and the right post 82 includes a pivot 84 having a pivot axis 86. The pivot axis 86 extends parallel to the pivot axis 46. The shelf end 56 of the left arm 50 is coupled to the pivot 84 of the left post 80. The left arm 50 is configured to move relative to the left post 80 when the drive screw 34 is rotated. The left arm 50 rotates about the pivot axis 86 of pivot 84 of the left post 80 when the drive screw 34 is rotated. The shelf end 56 of the right arm 52 is coupled to the pivot 84 of the right post 82. The right arm 52 is configured to move relative to the right post 82 when the drive screw 34 is rotated. The right arm 52 rotates about the pivot axis 86 of pivot 84 of the right post 82 when the drive screw 34 is rotated. Accordingly, rotating the drive screw 34 causes the slides 40 and 42 to move the arms 50 and 52 so that the shelf 60 is moved between the retracted and expanded position, as described below. In the illustrated embodiment, a motor 88 is coupled to the drive screw 34 and configured to rotate the drive screw 34 to move the shelf 60 between the retracted position and the extended position. In other embodiments, the drive screw 34 can be driven manually.

In the extended position, the shelf 60 can be spaced apart from a wall to which the fixture 10 is attached. A left bumper housing 90 is coupled to the shelf 60. In one embodiment, the left bumper housing 90 is coupled to a bottom 110 of the shelf 60. A left bumper 92 extends from and retracts into the left bumper housing 90 so that an end 94 of the left bumper 92 positions on the wall to prevent the shelf 60 from being moved toward the wall while the shelf 60 is in use. A stopper 96 is coupled to the end 94 of the left bumper 92 to provide a cushion against the wall and prevent scratches or other damage to the wall. In some embodiments, the stopper 96 is formed from at least one of rubber or plastic. A right bumper housing 100 is coupled to the shelf 60. In one embodiment, the right bumper housing 100 is coupled to a bottom 110 of the shelf 60. A right bumper 102 extends from and retracts into the right bumper housing 100 so that an end 104 of the right bumper 102 positions on the wall to prevent the shelf 60 from being moved toward the wall while the shelf 60 is in use. A stopper 106 is coupled to the end 104 of the right bumper 102 to provide a cushion against the wall and prevent scratches or other damage to the wall. In some embodiments, the stopper 106 is formed from at least one of rubber or plastic.

The shelf 60 includes the bottom 110 and an opposite top 112. An opening 114 extends through the shelf 60 from the top 112 to the bottom 110. An outer lip 116 extends into the opening 114 from each of the back end 62, the front end 64, the left side 66, and the right side 68. In some embodiments, the outer lip 116 extends only from the back end 62 and the front end 64. In another embodiment, the outer lip 116 extends only from the left side 66 and right side 68. An inner lip 118 extends into the opening 114 from the outer lip 116.

Figure 11:
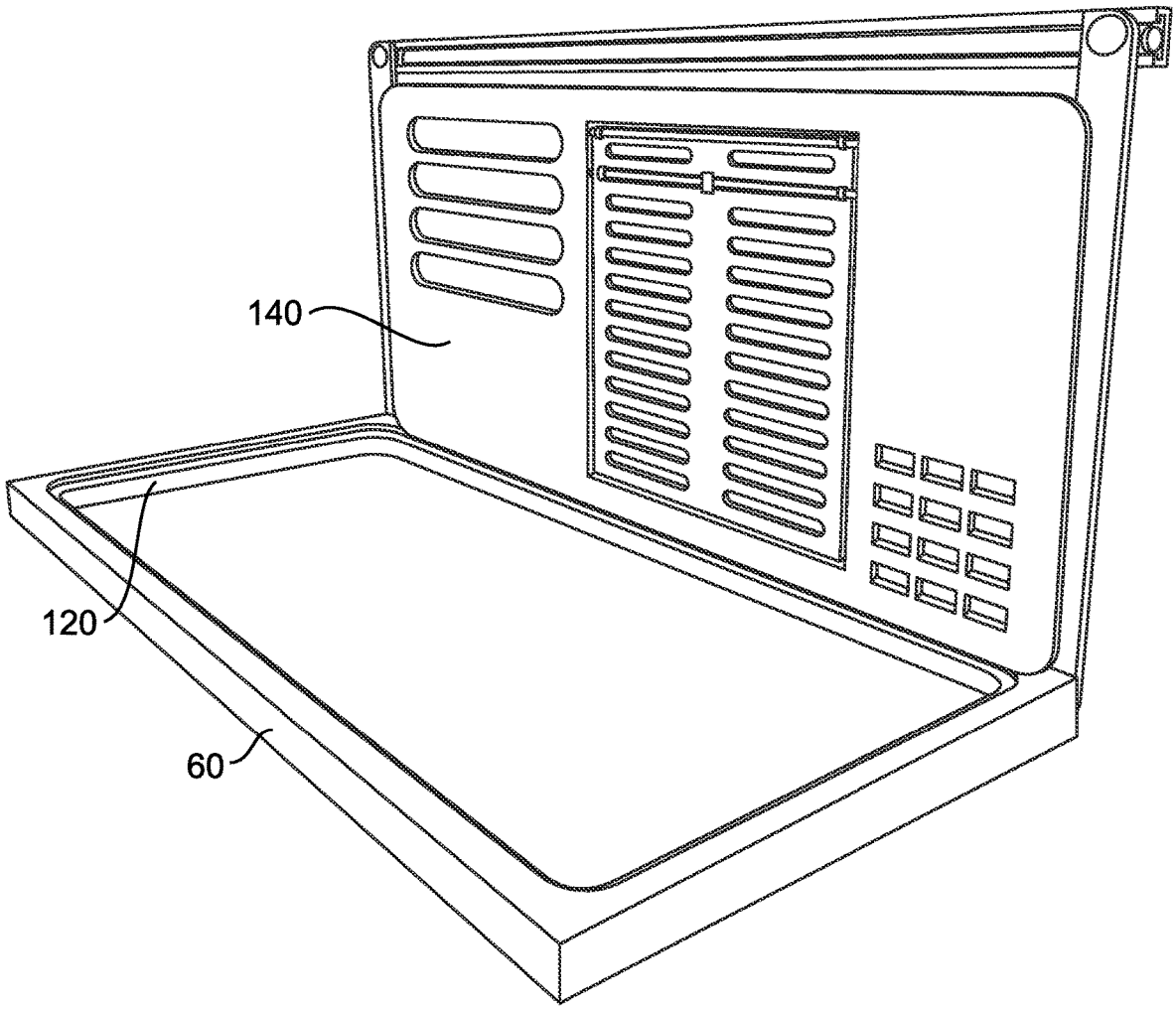
FIG. 11 is a perspective view on an insert of the shelving unit shown in FIG. 1 in a raised position, wherein the insert can also be used with the shelving unit shown in FIGS. 8-10.

The inner lip 118 is configured to hold a tray 120. The tray 120 includes an outer wall 122 and a bottom 124. The outer wall 122 and the bottom 124 define a cavity 126. The outer lip 116 is configured to retain an insert 140 that positions over the tray 120. The insert 140 includes a plurality of spaces 142 that can be configured to retain various objects, for example, dishes. The insert 140 can be rotated relative to the tray 120, as shown in FIG. 11, to provide access to the cavity 126 in the tray 120 for storage.

Figure 12:
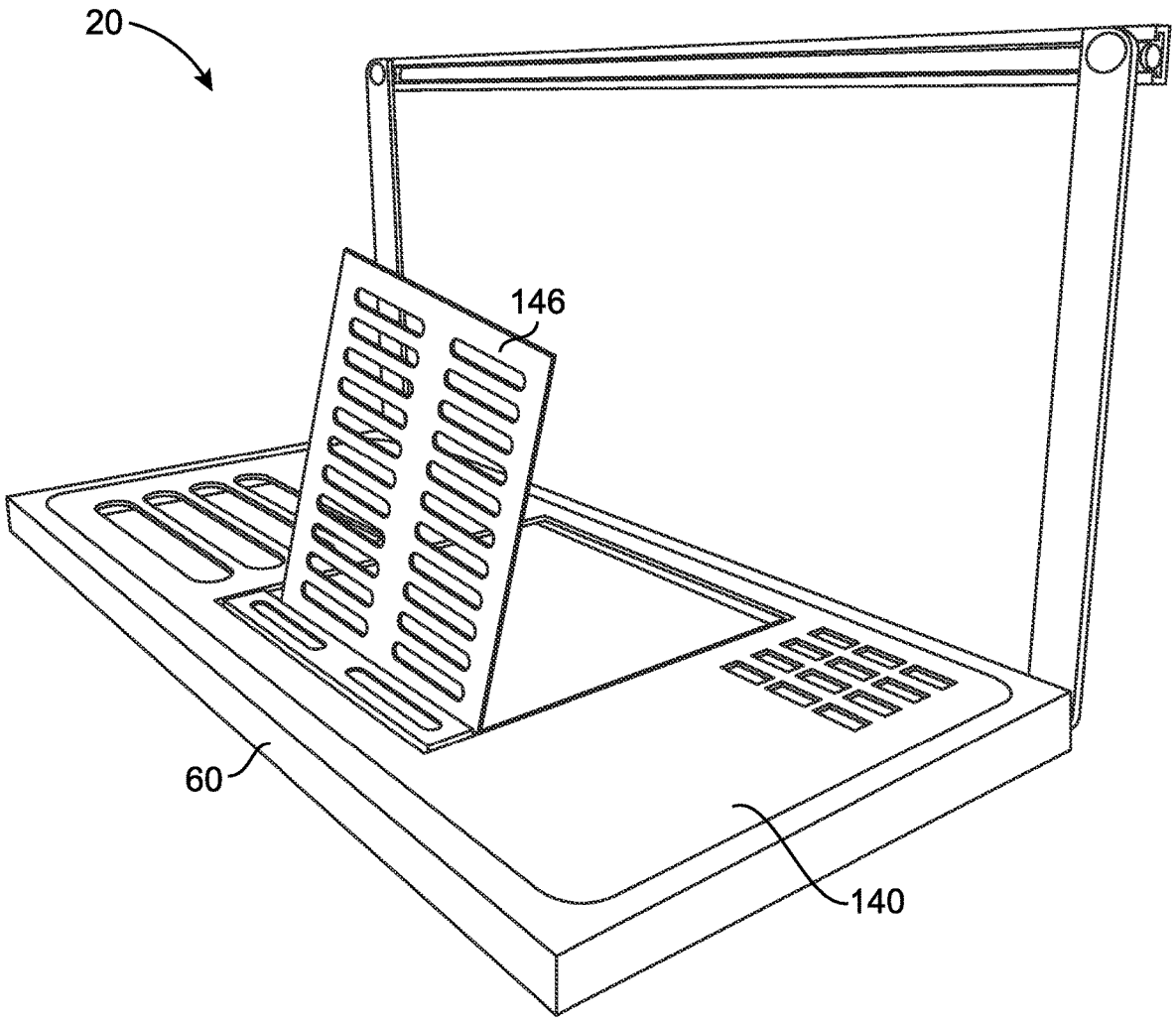
FIG. 12 is a perspective view of the insert shown in FIG. 11 in a lowered position with a panel of the insert in a raised position.

The insert 140 also includes an opening 144. A panel 146 positions in the opening 144. The panel 146 includes pivots 148 that enable the panel 146 to rotate relative to the insert 140, as shown in FIG. 12. With the panel 146 rotated upward, objects can be positioned upright against the panel 146. For example, the panel 146 can be configured to hold a cookbook or mobile device. When the panel 146 is in the lowered position, spaces 148 in the panel 146 can hold objects, for example dishes.

Figure 13:
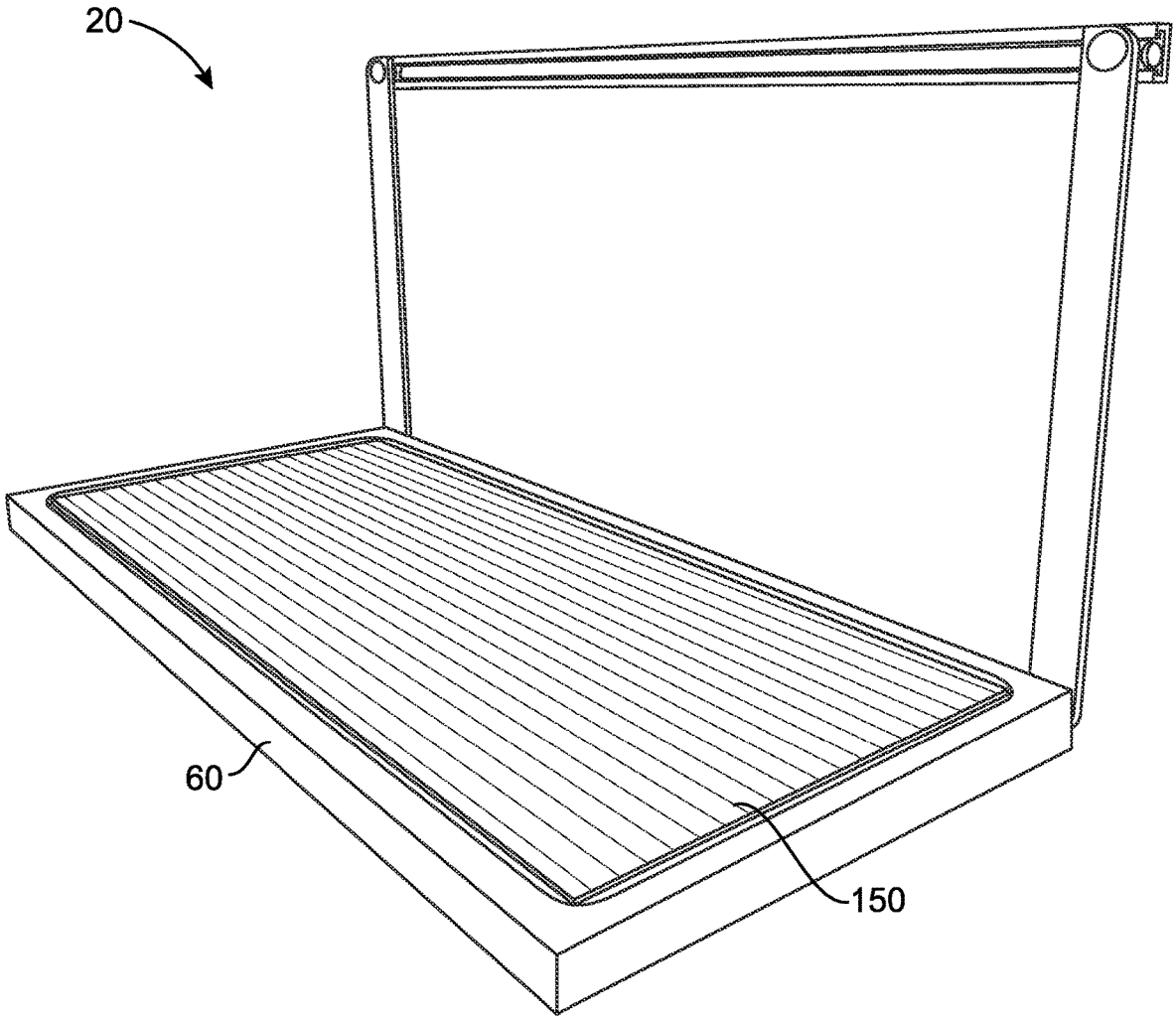
FIG. 13 is a perspective view of another embodiment of an insert positioned on the shelving unit shown in FIG. 1, wherein the insert can also be used with the shelving unit shown in FIGS. 8-10.

In some embodiments, the insert 140 can be removed to provide access to the cavity 126 in the tray 120. In some embodiments, one of a plurality of inserts can replace the insert 140. Each of the plurality of inserts can be tailored to a specific function. As illustrated in FIG. 13, a cutting board 150 can be positioned in the tray 120. In some embodiments, the cutting board 150 is positioned on the outer lip 116 or the inner lip 118 of the shelf 60.

In some embodiments, a height 180 of the shelf 60 is less than ¾" (1.9 cm). It will be appreciated that in some embodiments, the height 180 of the shelf 60 is greater than ¾" (1.9 cm). In some embodiments, the depth 70 of the left side 66 and the right side 68 of the shelf 60 does not exceed 10¾" (27.3 cm). In other embodiments wherein the fixture 10 has a greater depth, the depth 70 of the left side 66 and the right side 68 of the shelf 60 can exceed 10¾" (27.3 cm). A width 190 of the shelf is determined by a width of the fixture 10. In some embodiments, the overall width 190 does not exceed 21½" (54.6 cm) so that the tray 120 is sized and shaped to be positioned in a dishwasher. In such an embodiment, the length 58 of each of the left arm 50 and the right arm 52 does not exceed 10¾" (27.3 cm). In other embodiments, the overall width 190 does exceed 21½" (54.6 cm) for use with larger fixtures 10. For example, the shelf 60 may be sized to hold longer guns, camping devices, etc. in a camper.

Figure 5:
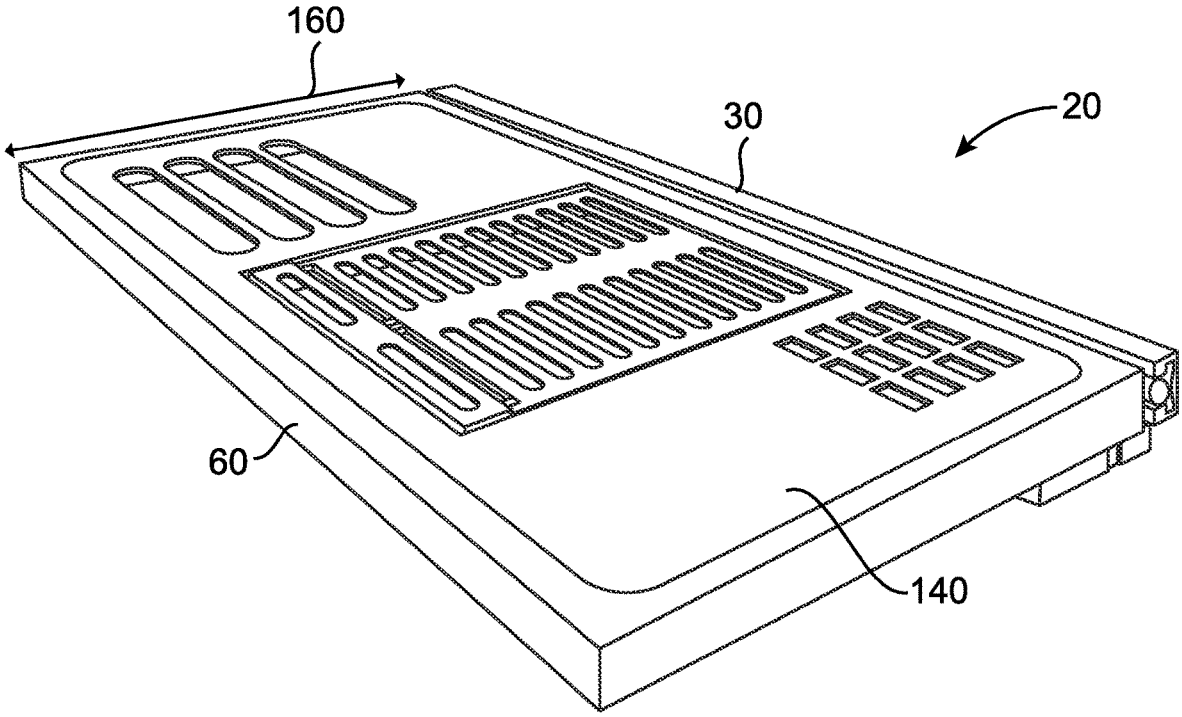
FIG. 5 is perspective view of the shelving unit shown in FIG. 1 in the retracted position.
Figure 6:
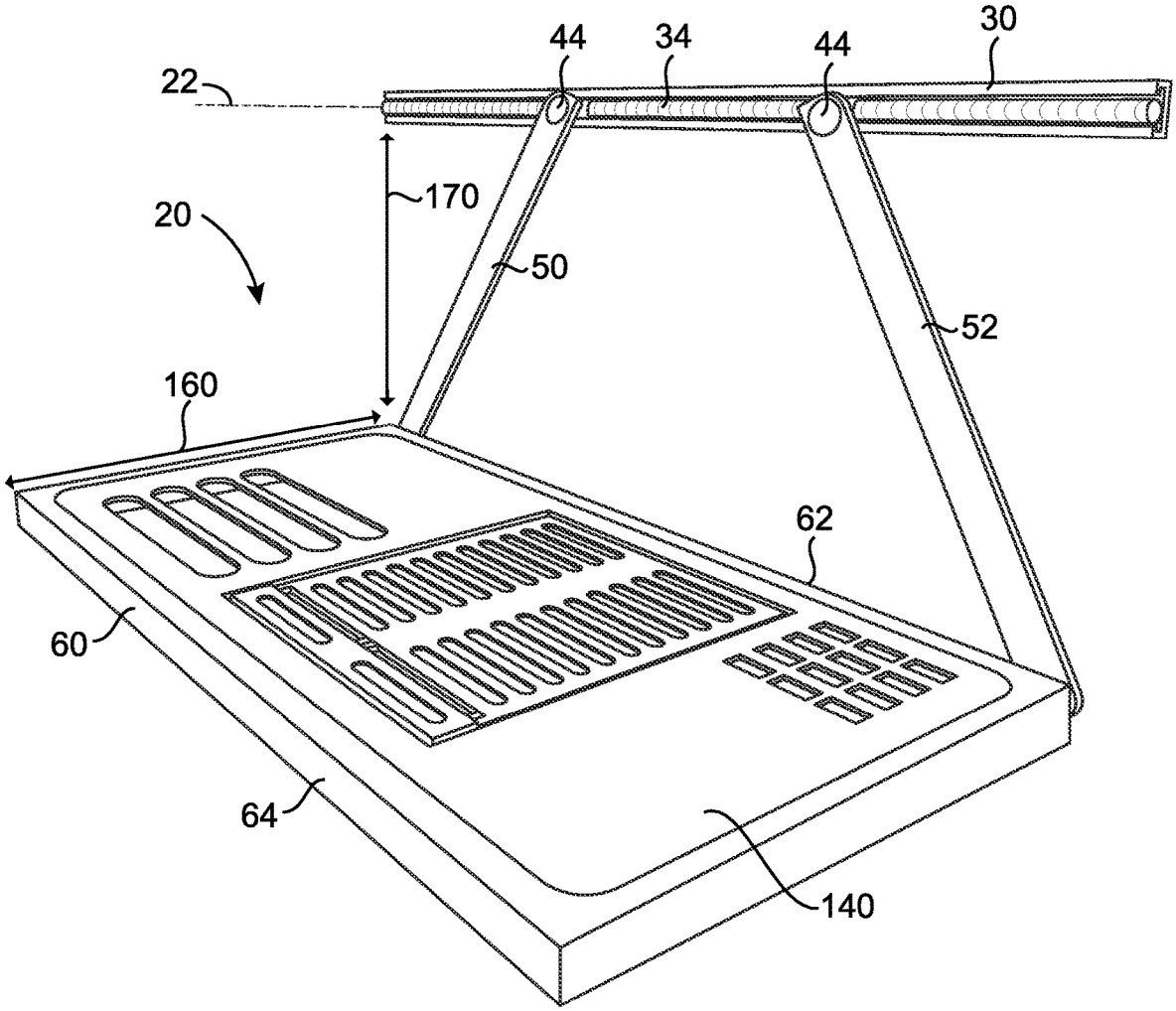
FIG. 6 is a perspective view of the shelving unit shown in FIG. 1 in an intermediate position between the retracted position and the expanded position.
Figure 7:
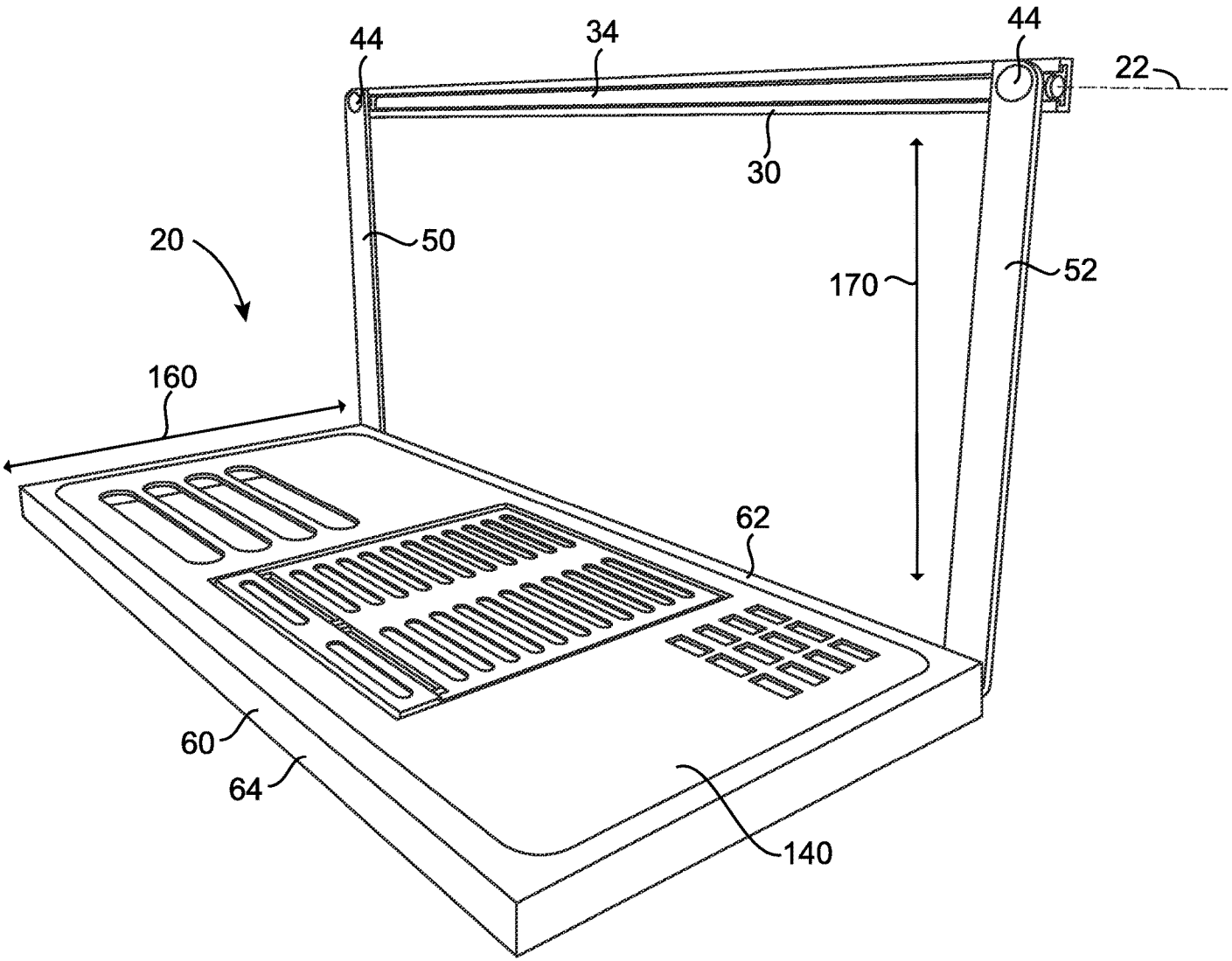
FIG. 7 is a perspective view of the shelving unit shown in FIG. 1 in the expanded position.

Referring now to FIGS. 5-7, in the retracted position, shown in FIG. 5, the shelf 60 is positioned within the cavity 18 of the fixture 10. A front end 64 of the shelf 60 is cantilevered in the retracted position. The shelf 60 is moved between the retracted position and the expanded position, shown in FIG. 7, through a series of intermediate positions, one of which is illustrated in FIG. 6. The front end 64 of the shelf 60 is also cantilevered in the expanded position. In the illustrative embodiment, the shelf 60 extends in a horizontal plane 160 in both the retracted position and the extended position. In the illustrative embodiment, the shelf 60 remains in the horizontal plane 160 when moving between the retracted position and the extended position.

The shelf 60 is moved through rotation of the drive screw 34. For example, the drive screw 34 is rotated by actuation of the motor 88. As the drive screw 34 rotates the left slide 40 and the right slide 42 move along the drive screw axis 22. When the shelf 60 is lowered to the expanded position, the left slide 40 and the right slide 42 move in opposite directions away from one another. When the shelf 60 is raised to the retracted position, the left slide 40 and the right slide 42 move in opposite directions toward another.

As the left slide 40 and the right slide 42 move, the track ends 54 of the left arm 50 and the right arm 52 move relative to the left slide 40 and the right slide 42. In the illustrated embodiment, the left arm 50 and the right arm 52 rotate about the respective pivot 44 relative to the left slide 40 and the right slide 42. Concurrently, the shelf ends 56 of the left arm 50 and the right arm 52 move relative to the back end 62 of the shelf 60. In the illustrated embodiment, the left arm 50 and the right arm 52 rotate relative to the back end 62 of the shelf 60. The left arm 50 and the right arm 52 rotate about the respective pivot 84 of the left post 80 and the right post 82.

During movement between the retracted position and the expanded position, the back end 62 of the shelf 60 moves in a plane 170 between the retracted position and the extended position. In the illustrative embodiment, the plane 170 is a vertical plane. In the illustrative embodiment, the plane 170 is orthogonal to the horizontal plane 160. The track end 54 of each of the left arm 50 and the right arm 52 moves with the left slide 40 and the right slide 42 along the drive screw axis 22 of the track 30. The drive screw axis 22 extends in a different direction than the plane 170. In the illustrated embodiment, the drive screw axis 22 is orthogonal to the plane 170.

Figure 8:
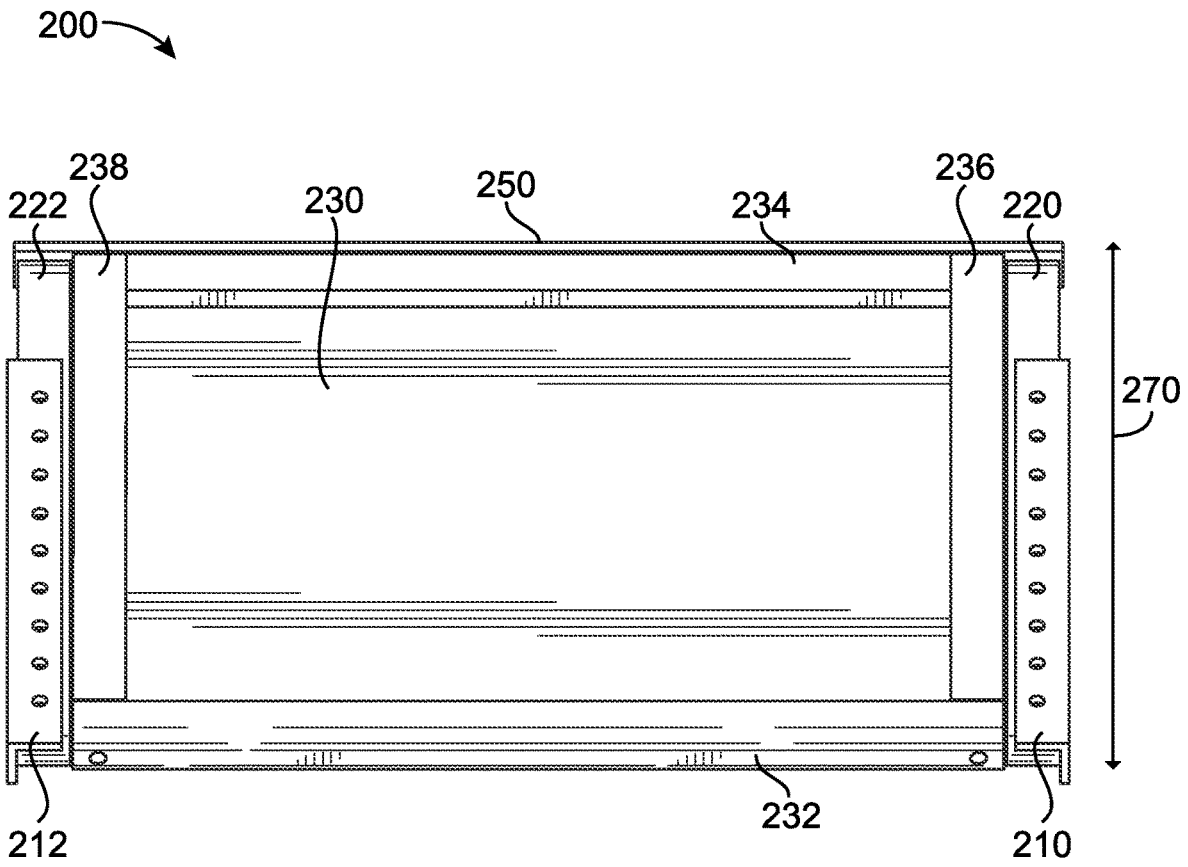
FIG. 8 is a perspective view of another embodiment of a shelving unit in a retracted position.
Figure 9:
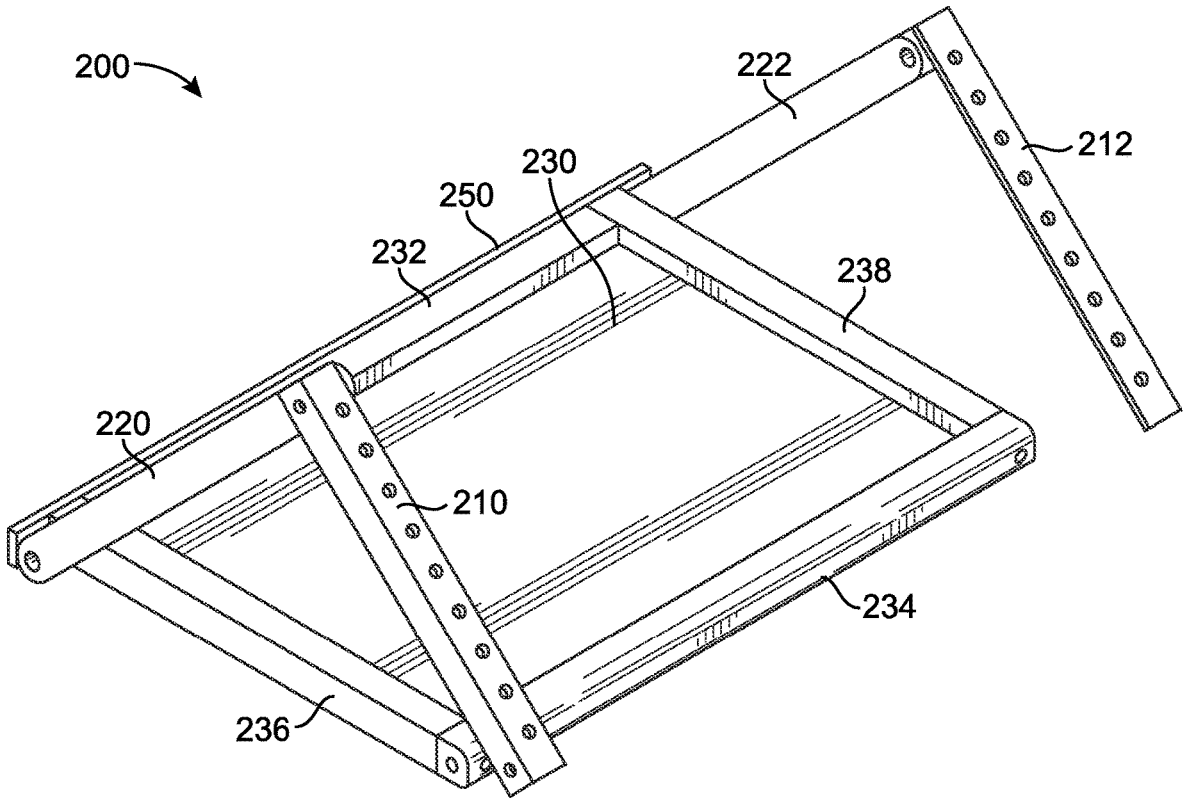
FIG. 9 is a perspective view of the shelving unit shown in FIG. 8 in an intermediate position between the retracted position and an expanded position.
Figure 10:
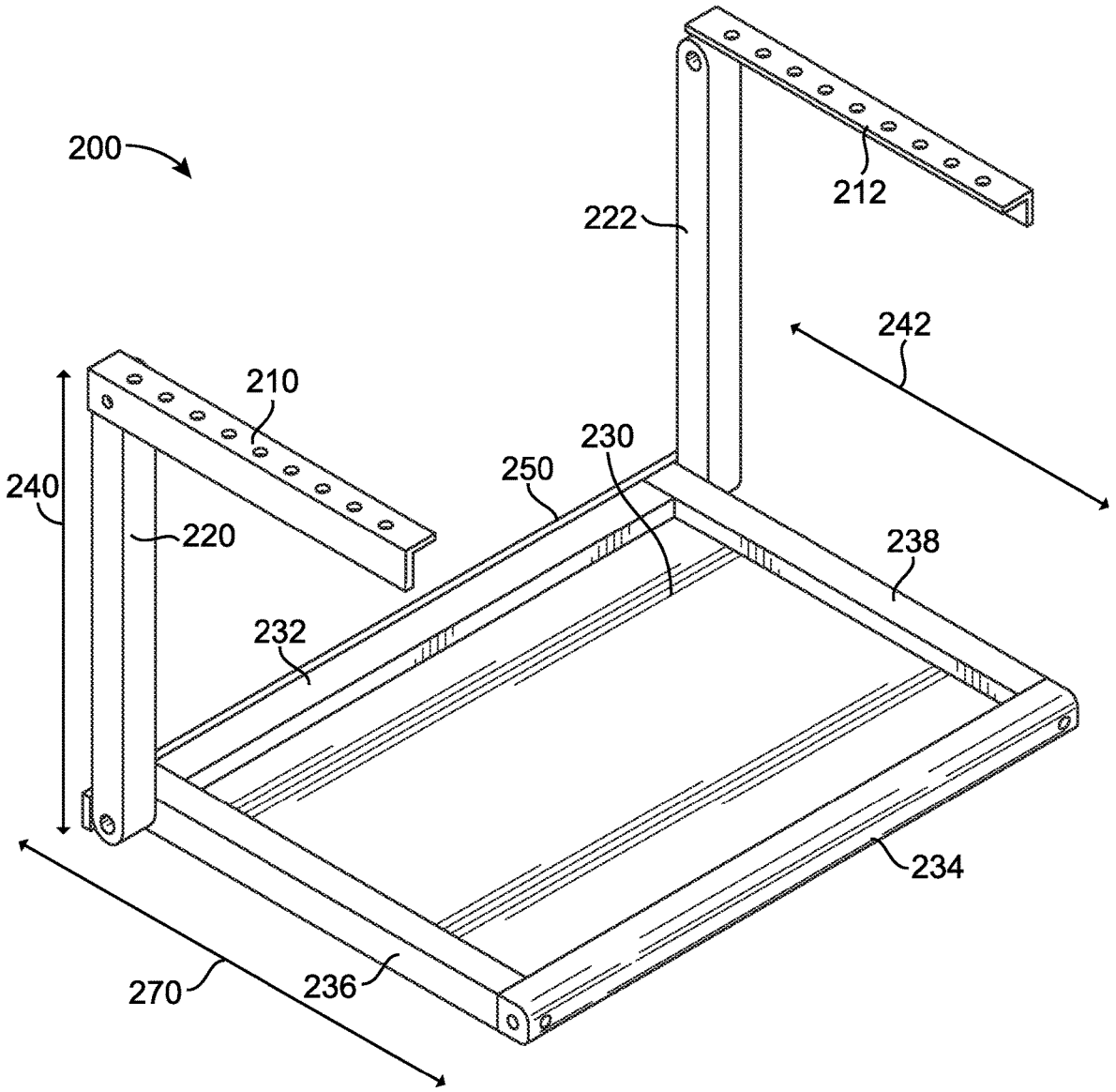
FIG. 10 is a perspective view of the shelving unit shown in FIG. 8 in the expanded position.

Referring to FIGS. 8-10, another embodiment of a shelving unit 200 is configured to move between a retracted position, shown in FIG. 8, and an expanded position, shown in FIG. 10, through a series of intermediate positions, one of which is shown in FIG. 9. The shelving unit 200 provides a less expensive fabrication than the shelving unit 20 and/or narrower shelves that do not allow for pivoting from center to obtain significant down-position. The shelving unit 200 is configured to couple to the fixture 10. The shelving unit 200 is coupled to an underside of the fixture 10. That is, the shelving unit 200 is sized to be stored under the fixture 10 in a retracted position, as illustrated in FIG. 8.

The shelving unit 200 extends into an expanded position under the fixture 10, as illustrated in FIG. 10. In the expanded position, the shelving unit 200 is configured to provide additional storage. For example, the shelving unit 200 may include a cutting board, storage for mobile devices, space for cookbooks, a drying rack for dishes, space for cooking sheets, etc. Accordingly, in a kitchen setting, the shelving unit 200 provides space in addition to the counter space of the kitchen. The shelving unit 200 does not include any front obstructions, thereby allowing for larger pans or skillets to sit atop the shelving unit 200.

The shelving unit 200 includes a left mounting bracket 210 and a right mounting bracket 212. The left mounting bracket 210 and the right mounting bracket 212 are configured to be secured to the fixture 10. For example, the left mounting bracket 210 and the right mounting bracket 212 are configured to secure to the bottom 16 of the fixture 10.

A left arm 220 is pivotally attached to the left mounting bracket 210. The left arm 220 moves relative to the left mounting bracket 210 when the shelving unit moves between the retracted and expanded position. In the illustrative embodiment, the left arm 220 rotates relative to the left mounting bracket 210 when the shelving unit moves between the retracted and expanded position. A right arm 222 is pivotally attached to the right mounting bracket 212. The right arm 222 moves relative to the right mounting bracket 212 when the shelving unit moves between the retracted and expanded position. In the illustrative embodiment, the right arm 222 rotates relative to the right mounting bracket 212 when the shelving unit moves between the retracted and expanded position.

The left arm 220 and the right arm 222 are both coupled to a shelf 230. The left arm 220 and the right arm 222 move relative to the shelf 230 when the shelving unit moves between the retracted and expanded position. In the illustrative embodiment, the left arm 220 and the right arm 222 rotate relative to the shelf 230 when the shelving unit moves between the retracted and expanded position. The shelf 230 is sized and shaped to position in the cavity 18 of the fixture 10 when the shelving unit 200 is in the retracted position. The shelf 230 extends in a horizontal plane 270 in both the retracted position and the extended position. The shelf 230 includes a back end 232 that is positioned adjacent a wall to which the fixture 10 is attached. The left arm 220 and the right arm 222 are coupled to the back end 232 of the shelf 230. The shelf 230 also includes a front end 234 positioned opposite the back end 232. The front end 234 of the shelf 230 is configured to be cantilevered when the shelving unit 200 is in the expanded position. A left side 236 and a right side 238 extend between the back end 232 and the front end 234. In some embodiments, a length 240 of each of the left arm 220 and the right arm 222 is no more than a depth 242 of the left side 236 and the right side 238 of the shelf 230.

In the extended position, the shelf 230 can be spaced apart from a wall to which the fixture 10 is attached. A bumper 250 extends from the back end 232 of the shelf 230 and positions on the wall to prevent the shelf 230 from being moved toward the wall while the shelf 230 is in use. In some embodiments, the bumper 250 is formed from at least one of rubber or plastic.

The shelf 230 is configured similarly to the shelf 60. The shelf 230 is configured to retain the tray 120 and the insert 140. The shelf 230 is also configured to retain the plurality of inserts described above that can replace the insert 140. The shelf 230 is also configured to retain the cutting board 150, shown in FIG. 13.

Figure 14:
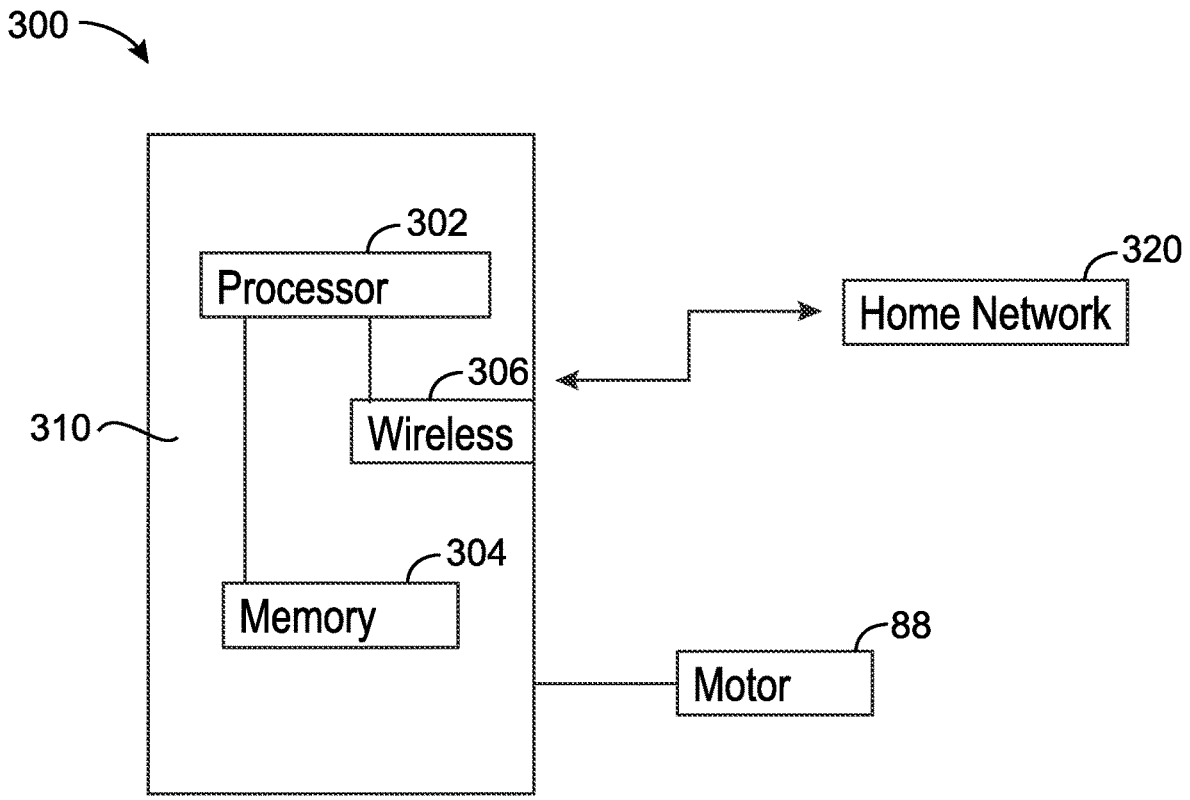
FIG. 14 is a schematic view of control circuitry for the shelving unit shown in FIG. 1.

Referring now to FIG. 14, a control circuitry 300 can be operable to control the shelving unit 20. The control circuitry 300 includes a computer device 310 having a processor 302 and a memory 304. The memory 304 includes instructions that, when carried out by the processor 302 cause the control circuitry 300 to control the shelving unit 20. The control circuitry 300 also includes the motor 88 and a wireless connection 306 configured to communicate with a home network 320. In some embodiments, the home network 320 is capable of receiving voice commands. For example, the voice commands can include "lower the shelf," "raise the shelf," or the like. Upon receiving a voice command, the home network 320 can send a signal to the control circuitry 300 via the wireless connection 306 to cause to processor 302 to activate the motor 88 to move the shelf 60 between the retracted and expanded position. It will be appreciated that the motor 88 can also include a power switch to manually activate the motor 88. It will also be appreciated that the shelving unit 200 can be equipped with a motor and linkages to move the shelf 230 between the retracted and expanded positions.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and many combinations of aspects and principles are possible in light of the various embodiments provided above.

The invention claimed is:

1. A shelving unit comprising:

a shelf configured to move between a retracted position and an extended position, the shelf having a back end configured to secure to a fixture in both the retracted position and the extended position, the shelf having a front end positioned opposite the back and cantilevered in both the retracted position and the extended position, at least one arm extending from the shelf, the at least one arm having a shelf end coupled to the back end of the shelf and an opposite track end, and a track secured to the fixture, wherein the track end of the at least one arm is moveably coupled to the track and configured to move along the track to move the shelf between the retracted position and the extended position, wherein the at least one arm comprises a pair of arms, wherein a first arm of the pair of arms is coupled to a first side of the shelf and a second arm of the pair of arms is coupled to a second side of the shelf, wherein a length of both the first arm and the second arm is no more than half a width of the track, and wherein a track end of the first arm and a track end of the second arm move in opposite directions along the track when the shelf is moved between the retracted position and the extended position.

2. The shelving unit of claim 1, wherein:

the back end of the shelf moves in a plane between the retracted position and the extended position, and the track end of the at least one arm moves along an axis along the track to move the shelf between the retracted position and the extended position, wherein the axis extends in a different direction than the plane.

3. The shelving unit of claim 2, wherein the axis is orthogonal to the plane.

4. The shelving unit of claim 1, wherein the shelf end of the at least one arm rotates relative to the back end of the shelf to move the shelf between the retracted position and the extended position.

5. The shelving unit of claim 1, further comprising a motor configured to move the track end of the at least one arm along the track to move the shelf between the retracted position and the extended position.

6. The shelving unit of claim 1, further comprising a plurality of inserts configured to be interchangeably positioned in the shelf.

7. The shelving unit of claim 6, wherein at least one of the plurality of inserts can be rotated to an angle relative to the shelf.

8. The shelving unit of claim 1, wherein the shelf extends in a horizontal plane in both the retracted position and the extended position.

9. The shelving unit of claim 8, wherein the shelf remains in the horizontal plane when moving between the retracted position and the extended position.

10. The shelving unit of claim 1, wherein the fixture is a cabinet and the shelf is sized to position under the cabinet in both the retracted position and the extended position.

11. The shelving unit of claim 10, wherein the cabinet is positioned on a wall, and the shelving unit further comprises at least one bumper positioned on the back end of the shelf to space the shelf from the wall.

* * * * *